US010400301B2

(12) United States Patent
Han et al.

(10) Patent No.: US 10,400,301 B2
(45) Date of Patent: Sep. 3, 2019

(54) DUAL-PHASE STEEL SHEET WITH EXCELLENT FORMABILITY AND MANUFACTURING METHOD THEREFOR

(71) Applicant: POSCO, Pohang-si, Gyeongsangbuk-do (KR)

(72) Inventors: Sang-Ho Han, Gwangyang-si (KR); Yeon-Sang Ahn, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 185 days.

(21) Appl. No.: 15/528,989

(22) PCT Filed: Nov. 26, 2015

(86) PCT No.: PCT/KR2015/012746

§ 371 (c)(1),
(2) Date: May 23, 2017

(87) PCT Pub. No.: WO2016/093513

PCT Pub. Date: Jun. 16, 2016

(65) Prior Publication Data

US 2017/0306438 A1 Oct. 26, 2017

(30) Foreign Application Priority Data

Dec. 10, 2014 (KR) ..... 10-2014-0177837

(51) Int. Cl.

| | |
|---|---|
| ***C21D 9/46*** | (2006.01) |
| ***C21D 8/02*** | (2006.01) |
| ***C21D 9/56*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/32*** | (2006.01) |
| ***C23C 2/06*** | (2006.01) |
| ***C23C 2/40*** | (2006.01) |
| ***C22C 38/12*** | (2006.01) |
| ***C22C 38/38*** | (2006.01) |

(52) U.S. Cl.

CPC ..... *C21D 9/46* (2013.01); *C21D 8/0205* (2013.01); *C21D 8/0226* (2013.01); *C21D 8/0236* (2013.01); *C21D 8/0273* (2013.01); *C21D 8/0278* (2013.01); *C21D 9/56* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/22* (2013.01); *C22C 38/32* (2013.01); *C22C 38/38* (2013.01); *C23C 2/06* (2013.01); *C23C 2/40* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 2007/0029015 | A1* | 2/2007 | Yoshinaga | C21D 6/005 148/533 |
| 2009/0139611 | A1 | 6/2009 | Kimura et al. | |
| 2012/0328901 | A1 | 12/2012 | Nonaka et al. | |
| 2014/0230973 | A1 | 8/2014 | Fukumoto et al. | |
| 2014/0242414 | A1 | 8/2014 | Minami et al. | |
| 2016/0060724 | A1 | 3/2016 | Kang et al. | |

FOREIGN PATENT DOCUMENTS

| | | | | |
|---|---|---|---|---|
| CN | 102712973 | A * | 10/2012 | C21D 8/0436 |
| CN | 102712973 | A | 10/2012 | |
| CN | 103703157 | A | 4/2014 | |
| CN | 103857815 | A | 6/2014 | |
| EP | 1201780 | A1 | 5/2002 | |
| EP | 1338667 | A1 | 8/2003 | |
| EP | 2169091 | A1 | 3/2010 | |
| EP | 2554687 | A1 | 2/2013 | |
| JP | 2004-292891 | A | 10/2004 | |
| JP | 2005-264176 | A | 9/2005 | |
| JP | 2007-211338 | A | 8/2007 | |
| KR | 10-2002-0022639 | A | 3/2002 | |
| KR | 2002-0073564 | A | 9/2002 | |
| KR | 10-2010-0023025 | A | 3/2010 | |
| KR | 10-2012-0033008 | A | 4/2012 | |
| KR | 10-2012-0132834 | A | 12/2012 | |
| KR | 10-2012-0134711 | A | 12/2012 | |
| KR | 10-2014-0024678 | A | 3/2014 | |
| KR | 101377861 | B1 * | 3/2014 | |

(Continued)

OTHER PUBLICATIONS

International Search Report dated Feb. 29, 2016 issued in International Patent Application No. PCT/KR2015/012746 (with English translation).

Chinese Office Action dated Mar. 19, 2018 issued in Chinese Patent Application No. 201580067763.0.

Search Report issued in corresponding European Patent Application No. 15866709.7 dated Sep. 7, 2017.

Japanese Office Action dated Sep. 28, 2018 issued in Japanese Patent Application No. 2017-530609.

*Primary Examiner* — Jenny R Wu

(74) *Attorney, Agent, or Firm* — Morgan, Lewis & Bockius LLP

(57) ABSTRACT

The present invention relates to a high-strength steel sheet and, more specifically, to a dual-phase steel sheet having excellent formability, so as to be appropriately applied to vehicle panels and the like, and a manufacturing method therefor.

7 Claims, 1 Drawing Sheet

(56) References Cited

FOREIGN PATENT DOCUMENTS

| | | | |
|---|---|---|---|
| KR | 10-2014-0057660 | A | 5/2014 |
| WO | 2014-157822 | A1 | 10/2014 |

* cited by examiner

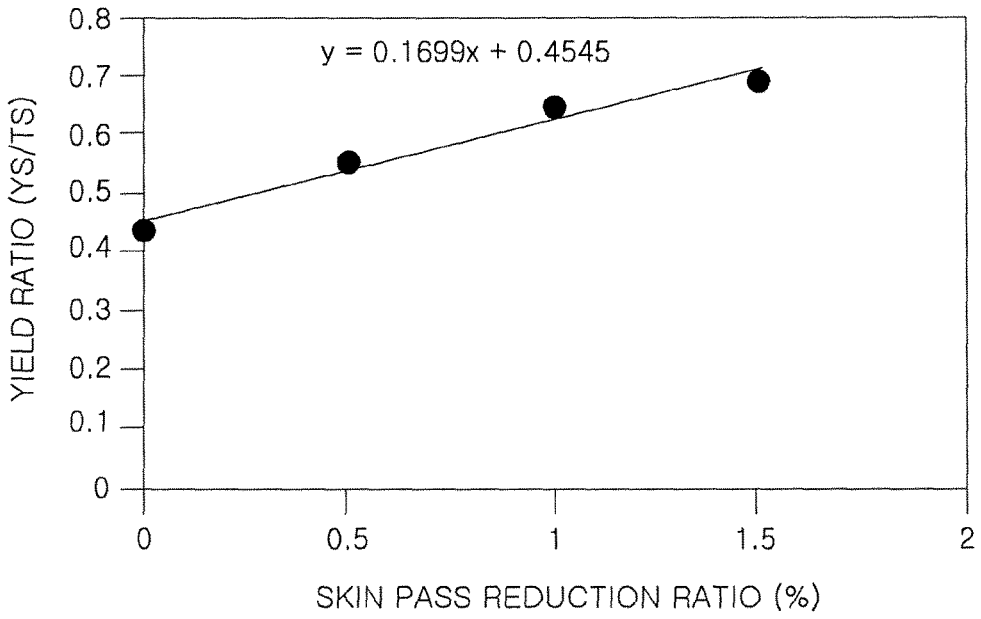
y = 0.1699x + 0.4545
YIELD RATIO (YS/TS)
0.8
0.7
0.6
0.5
0.4
0.3
0.2
0.1
0
0
0.5
1
1.5
2
SKIN PASS REDUCTION RATIO (%)

DUAL-PHASE STEEL SHEET WITH EXCELLENT FORMABILITY AND MANUFACTURING METHOD THEREFOR

CROSS REFERENCE

This patent application is the U.S. National Phase under 35 U.S.C. § 371 of International Application No. PCT/KR2015/012746, filed on Nov. 26, 2015, which claims the benefit of Korean Patent Application No. 10-2014-0177837, filed on Dec. 10, 2014, the entire contents of each are hereby incorporated by reference.

TECHNICAL FIELD

The present disclosure relates to a high-strength steel sheet and, more particularly, to a complex-phase steel sheet with excellent formability, which may be properly applied in an automotive exterior panel or the like, and a manufacturing method therefor.

BACKGROUND ART

High-strength steels have been actively used to meet requirements for both lightweightedness and high strength, in automobile bodies, with an emphasis on the impact resistance stability regulations and fuel efficiency of automobiles. In accordance with this trend, the application of high-strength steels to automotive exterior panels has also been extended. At present, 340 MPa-grade bake hardened steel is most commonly used in automotive exterior panels, but some 490 MPa-grade steel sheets have been used therein, and this trend is expected to continue to be extended to 590 MPa-grade steel sheets.

As described above, when steel sheets having increased strength are employed as exterior panels, lightweightedness and dent resistance may be improved, while, as the strength increases, formability during processing may decrease. Hence, in order to compensate for insufficient formability while applying high-strength steels to exterior panels, steel sheets having a relatively low level yield ratio (YR=YS/TS) and a relatively high level of ductility have been required by automobile manufacturers.

Furthermore, steel sheets employed as automotive exterior panels are required to have excellent surface quality, but it is difficult to secure plating surface quality due to hardenable elements or oxidizing elements, such as silicon (Si) or manganese (Mn), added to provide high strength.

Moreover, since steel sheets for automobiles are required to have high levels of corrosion resistance, hot-dip galvanized steel sheets having excellent corrosion resistance have been used as steel sheets for automobiles in the related art. Such steel sheets are manufactured by continuous hot-dip galvanizing equipment that performs recrystallization annealing and plating on the same production line, and thus steel sheets having high levels of corrosion resistance may be produced at low cost.

Further, galvannealed steel sheets subjected to a heat treatment after being hot-dip galvanized have been widely used due to having excellent weldability and formability, as well as outstanding corrosion resistance.

Thus, the development of high-tensile cold-rolled steel sheets having excellent formability has been required to improve lightweightedness and processability of automotive exterior panels. In addition, the development of high-tensile hot-dip galvanized steel sheets having excellent corrosion resistance, weldability, and formability has been required.

As a technology in the related art for improving processability of high-tensile steel sheets, Patent Document 1 discloses a steel sheet having a complex-phase structure using martensite as a main component, and a method of manufacturing the high-tensile steel sheet, in which fine copper (Cu) precipitates having a particle diameter of 1 nm to 100 nm are dispersed in a complex-phase structure thereof, to improve processability.

Patent Document 1 requires the addition of Cu in an excessive amount of 2% to 5% to extract fine Cu particles, which may cause red shortness resulting from Cu and an excessive increase in manufacturing costs.

Patent Document 2 discloses a complex-phase steel sheet including ferrite as a main phase, retained austenite as a secondary phase, and bainite and martensite as a low-temperature transformation phase, and a method of improving the ductility and elongation flange properties of the steel sheet.

However, Patent Document 2, it is difficult to secure plating quality due to the addition of large amounts of silicon (Si) and aluminum (Al) to secure a retained austenite phase, and also difficult to secure surface quality during a steel manufacturing process and a steel continuous casting process. Further, transformation induced plasticity allows for a relatively high initial YS value, to increase a yield ratio.

Patent Document 3 discloses a steel sheet including soft ferrite and hard martensite as microstructures, and a manufacturing method thereof for improving an elongation percentage and an r value (a Lankford value) of the steel sheet, as a technology for providing a high-tensile hot-dip galvanized steel sheet having good processability.

However, this technology has difficulties in securing excellent plating quality due to the addition of Si in a large amount, and causes an increase in manufacturing costs because of the addition of titanium (Ti) and molybdenum (Mo) in large amounts.

Patent Document 1: Japanese Laid-Open Patent Publication No. 2005-264176

Patent Document 2: Japanese Laid-Open Patent Publication No. 2004-292891

Patent Document 3: Korean Published Patent Application No. 2002-0073564

DISCLOSURE

Technical Problem

An aspect of the present disclosure may provide a complex-phase steel sheet with excellent formability which may be properly applied in an automotive exterior panel and which may significantly improve a ratio of elongation to yield ratio (EL/YR) by optimizing alloy design and manufacturing conditions, and a method of manufacturing the same.

Technical Solution

According to an aspect of the present disclosure, a complex-phase steel sheet having excellent formability may include: by wt %, 0.01% to 0.08% of carbon (C), 1.5% to 2.5% of manganese (Mn), 1.0% or less (excluding 0%) of chromium (Cr), 1.0% or less (excluding 0%) of silicon (Si), 0.1% or less (excluding 0%) of phosphorus (P), 0.01% or less (excluding 0%) of sulfur (S), 0.01% or less (excluding 0%) of nitrogen (N), 0.02% to 0.1% of acid soluble aluminum (sol. Al), 0.1% or less (excluding 0%) of molybdenum (Mo), 0.003% or less (excluding 0%) of boron (B), and a balance of iron (Fe) and inevitable impurities, the sum (Mn+Cr) of wt % of manganese (Mn) and chromium (Cr) satisfying 1.5% to 3.5%, in which the complex-phase steel sheet may include ferrite as a main phase, a fraction of fine martensite at a ¼t point, based on a total thickness (t) of the complex-phase steel sheet, may be from 1% to 8%, an occupancy ratio (M %) of martensite having an average particle diameter of less than 1 μm and present in grain boundaries of ferrite defined as the following Formula 1, may be 90% or higher, and an area ratio (B %) of bainite of an overall secondary phase microstructure, defined as the following Formula 2, may be 3% or lower (including 0%).

$$M(\%)=\{M_{gb}/(M_{gb}+M_{in})\}\times 100, \quad \text{Formula 1}$$

where $M_{gb}$ may refer to the amount of martensite present in the grain boundaries of ferrite, and $M_{in}$ may refer to the amount of martensite present in crystal grains of ferrite.

$$B(\%)=\{BA/(MA+BA)\}\times 100, \quad \text{Formula 2}$$

where BA may refer to a bainite area, and MA may refer to a martensite area.

According to another aspect of the present disclosure, a method of manufacturing a complex-phase steel sheet having excellent formability may include: reheating a steel slab, including, by wt %, 0.01% to 0.08% of carbon (C), 1.5% to 2.5% of manganese (Mn), 1.0% or less (excluding 0%) of chromium (Cr), 1.0% or less (excluding 0%) of silicon (Si), 0.1% or less (excluding 0%) of phosphorus (P), 0.01% or less (excluding 0%) of sulfur (S), 0.01% or less (excluding 0%) of nitrogen (N), 0.02% to 0.1% of acid soluble aluminum (sol. Al), 0.1% or less (excluding 0%) of molybdenum (Mo), 0.003% or less (excluding 0%) of boron (B), and a balance of iron (Fe) and inevitable impurities, the sum (Mn+Cr) of wt % of manganese (Mn) and chromium (Cr) satisfying 1.5% to 3.5%; manufacturing a hot-rolled steel sheet by finish hot rolling the reheated steel slab at a transformation point Ar3 or higher; coiling the hot-rolled steel sheet at 450° C. to 700° C.; manufacturing a cold-rolled steel sheet by cold rolling the coiled hot-rolled steel at a reduction ratio of 40% to 80%; and annealing the cold-rolled steel sheet in a continuous annealing furnace or a continuous galvannealing furnace in a temperature range of 760° C. to 850° C., in which the annealed steel sheet may include ferrite as a main phase, a fraction of fine martensite at a ¼t point, based on a total thickness (t) of the annealed steel sheet may be from 1% to 8%, an occupancy ratio (M %) of martensite having an average particle diameter of less than 1 μm and present in grain boundaries of ferrite defined as the following Formula 1, may be 90% or higher, and an area ratio (B %) of bainite of an overall secondary phase microstructure, defined as the following Formula 2, may be 3% or lower (including 0%).

Advantageous Effects

According to an embodiment in the present disclosure, a complex-phase steel sheet that may simultaneously secure excellent strength and ductility may be provided. The complex-phase steel sheet may be appropriately applied in an automotive exterior panel that requires a high level of processability.

DESCRIPTION OF DRAWINGS

FIG. 1 is a graph of changes in a yield strength-to-tensile strength ratio (YS/TS) according to a skin pass reduction ratio of a complex-phase steel sheet, according to an embodiment in the present disclosure.

BEST MODE FOR INVENTION

The present inventors have researched in depth to provide a steel sheet having excellent formability, which may simultaneously secure strength and ductility so as to be suited for use in an automotive exterior panel, and have confirmed that a complex-phase steel sheet satisfying required physical properties may be provided by optimizing manufacturing conditions, as well as alloy design, to complete the present disclosure.

Hereinafter, an embodiment in the present disclosure will be described in detail.

First, a complex-phase steel sheet having excellent formability, according to an aspect in the present disclosure, will be described in detail.

According to an embodiment in the present disclosure, the complex-phase steel sheet may preferably include, by wt %, 0.01% to 0.08% of carbon (C), 1.5% to 2.5% of manganese (Mn), 1.0% or less (excluding 0%) of chromium (Cr), 1.0% or less (excluding 0%) of silicon (Si), 0.1% or less (excluding 0%) of phosphorus (P), 0.01% or less (excluding 0%) of sulfur (S), 0.01% or less (excluding 0%) of nitrogen (N), 0.02% to 0.1% of acid soluble aluminum (sol. Al), 0.1% or less (excluding 0%) of molybdenum (Mo), 0.003% or less (excluding 0%) of boron (B), and a balance of iron (Fe) and inevitable impurities, the sum (Mn+Cr) of wt % of manganese (Mn) and chromium (Cr) satisfying 1.5% to 3.5%.

Hereinafter, the reason for controlling the alloy components of the complex-phase steel sheet according to the embodiment will be described in detail and, unless otherwise stated, the contents of the respective components may be based on wt %.

C: 0.01% to 0.08%

Carbon (C) may be an important component in producing a steel sheet having complex-phase microstructures and may be an element advantageous in securing strength by forming martensite, one of the secondary phase microstructures. As a content of C increases, it may be easy to form martensite, which is advantageous in producing a complex-phase steel. However, the content of C may be required to be controlled to an appropriate level in order to control a required strength and yield ratio (YS/TS).

In particular, as the content of C increases, bainite transformation may occur simultaneously with cooling after annealing, and thus the yield ratio of steel may be increased. Thus, in the embodiment, it may be important to minimize the formation of bainite, if possible, and to form an appropriate level of martensite, securing required material properties.

Hence, the content of C may preferably be controlled to be 0.01% or more. When the content of C is less than 0.01%, a 490 MPa-grade strength required in the embodiment may be difficult to obtain, and it may also be difficult to form an appropriate level of martensite. In contrast, when the content of C exceeds 0.08%, the bainite formation may be promoted during cooling after annealing, the yield strength may be increased, and thus bending and surface defects may easily occur in processing automobile components. Thus, in the embodiment, the content of C may preferably be controlled to be 0.01% to 0.08%.

Mn: 1.5% to 2.5%

Mn may be an element improving hardenability in a steel sheet having complex-phase microstructures and, in particular, may be an important element in forming martensite. In a conventional solid solution-strengthened steel, Mn may be effective in increasing strength through a solid solution strengthening effect, and may serve an important function in suppressing the occurrence of sheet breakage and a high temperature embrittlement phenomenon caused by S during hot rolling, by precipitating S, inevitably added to steel, as MnS.

In the embodiment, it may be preferable to add 1.5% or more of such Mn to steel. When a content of Mn is less than 1.5%, martensite may not be formed, causing difficulties in manufacturing the complex-phase steel. In contrast, when the content of Mn exceeds 2.5%, martensite may be formed in an excessive amount to result in instability of the material, and a Mn-band (a band of a Mn oxide) may be formed in the microstructures to increase the risk of occurrence of processing cracking and sheet breakage. In addition, a problem may occur in which the Mn oxide is eluted on a surface during annealing, to significantly degrade plating characteristics. Thus, in the embodiment, the content of Mn may be limited to 1.5% to 2.5%.

Cr: 1.0% or less (excluding 0%)

Chromium (Cr) may be a component having characteristics similar to those of Mn described above, and may be an element added to improve hardenability of steel and secure high strength thereof. Such Cr may be an element effective in forming martensite and advantageous in manufacturing a complex-phase steel having a low yield ratio by forming a coarse Cr-based carbide, such as $Cr_{23}C_6$, in a hot rolling process to precipitate an amount of solid solution C included in steel at a proper level or lower, thus suppressing the occurrence of yield point-elongation (YP-EI). Further, Cr may also be advantageous in manufacturing a complex-phase steel having high ductility by minimizing a reduction in an elongation-to-strength ratio.

In the embodiment, Cr may facilitate the martensite formation through improvements in the hardenability. However, when a content of Cr exceeds 1.0%, a martensite formation ratio may be excessively increased, thus causing a problem in which the strength and the elongation are reduced. Thus, in the embodiment, it may be preferable to limit the content of Cr to 1.0% or less, and 0% may be excluded, considering an amount of Cr inevitably added in the manufacture.

Meanwhile, Mn and Cr may be important elements for improving the hardenability. In a case in which C is generally added in a content of more than 0.08% to form martensite, and the complex-phase steel is manufactured, it may be possible to manufacture the complex-phase steel even when contents of Mn and Cr are low. However, in this case, problems may occur such that the elongation may be reduced and it may be difficult to manufacture a low yield ratio-type steel sheet.

Accordingly, in the embodiment, C may be added in as small an amount as possible and, instead, the contents of Mn and Cr, strong hardenable elements, may be controlled to forma proper level of martensite, thus achieving physical properties, such as low yield ratio, improvements in elongation, or the like. At this time, it may be preferable to control the sum (Mn+Cr, wt %) of the contents of Mn and Cr to 1.5% to 3.5%. When the sum of the contents of Mn and Cr is less than 1.5%, a problem may occur in which almost no martensite is formed, which causes a rapid increase in the yield ratio and a YP-EI phenomenon, resulting in instability of the material. In contrast, when the sum of the contents of Mn and Cr exceeds 3.5%, a problem may occur in which martensite may be excessively formed and, in addition, bainite may be simultaneously formed, causing a rapid increase in the yield ratio, that is, the yield strength-to-tensile strength ratio, resulting in a frequent occurrence of defects, such as cracking or bending, during component processing. Thus, in the embodiment, the sum of the contents of Mn and Cr may be preferably controlled to 1.5% to 3.5%.

Si: 1.0% or less (excluding 0%)

In general, silicon (Si) may be an element which forms retained austenite at an appropriate level during annealing cooling, to significantly contribute to improvement in the elongation. However, Si may exhibit the above characteristics when the content of C is high, at about 0.6%. In addition, it is known that Si may serve a function to improve the strength of steel through a solid solution strengthening effect, or to raise surface characteristics of a plated steel sheet to an appropriate level or higher.

In the embodiment, a content of such Si may be limited to 1.0% or less (excluding 0%), which is to secure the strength and improve the elongation. Thus, there is no great problem in securing the physical properties, even without an addition of Si. However, 0% may be excluded, considering an amount of Si inevitably added in the manufacture. When the content of Si exceeds 1.0%, the plating surface characteristics may be degraded and, due to a low amount of solid solution C, retained austenite may not be formed, and thus there is no advantageous effect for improving the elongation.

P: 0.1% or less (excluding 0%)

Phosphorous (P) in steel may be an element most advantageous for securing strength without significantly degrading formability. However, when P is added excessively to steel, problems may occur in which the possibility of the occurrence of brittle fracture may significantly increase, to thus increase the possibility of the occurrence of steel fractures of a slab during hot rolling, and a problem may occur in which the excessive amount of P may act as an element degrading the plating surface characteristics.

Thus, in the embodiment, a content of P may be limited to a maximum of 0.1%, but 0% may be excluded, considering an amount of P that is added inevitably.

Sulfur (S): 0.01% or less (excluding 0%)

Sulfur (S) may be an impurity element in steel, as an inevitably added element, and it may be important to restrict a content of S to be as low a content as possible. In particular, since S in steel has a problem of increasing the possibility of the occurrence of red shortness, it may be preferable to control the content of S to 0.01% or less. However, 0% may be excluded, considering an amount of S inevitably added during a manufacturing process.

Nitrogen (N): 0.01% or less (excluding 0%)

Nitrogen (N) may be an impurity element in steel, as an inevitably added element. It may be important to restrict a content of such N to be as low a content as possible, but for this, there may be a problem in which a steel refining cost sharply increases. Thus, the content of N may be controlled, preferably to 0.01% or less, as a range in which an operating condition may be performed. However, 0% may be excluded, considering an amount of N that is added inevitably.

sol. Al: 0.02% to 0.1%

Soluble aluminum (sol. Al) may be an element added to miniaturize grain size of steel and deoxidize steel. When a content of sol. Al is less than 0.02%, an Al-killed steel may not be manufactured in a normal stable state. In contrast, when the content of sol. Al exceeds 0.1%, problems may occur in which it may be advantageous to increase the strength of steel due to a grain refinement effect, while a possibility of the occurrence of a defective surface of a plated steel sheet may be increased, due to excessive formation of inclusions during a steel manufacturing, continuous-casting operation, and manufacturing costs may be increased. Thus, in the embodiment, the content of sol. Al may be controlled, preferably to 0.02% to 0.1%.

Mo: 0.1% or less (excluding 0%)

Molybdenum (Mo) may be an element added to improve the strength and refinement of ferrite, while retarding transformation of austenite into pearlite. Such Mo may have the advantage of improving hardenability of steel to form martensite finely in grain boundaries, so as to control the yield ratio. However, a problem of the expense of Mo may be disadvantageous in manufacturing, as a content of Mo increases. Thus, it may be preferable to appropriately control the content of Mo.

In order to obtain the above-described effect, Mo may be added, preferably in an amount of a maximum of 0.1%. When the content of Mo exceeds 0.1%, the cost of an alloy may be rapidly increased and economic efficiency may thus be lowered, while the ductility of steel may also be degraded. In the embodiment, an optimal level of Mo may be 0.05%, but even when less than 0.05% of Mo is added, required physical properties may be secured. However, 0% may be excluded, considering an amount of Mo inevitably added during a manufacturing process.

Boron (B): 0.003% or Less (Excluding 0%)

Boron (B) in steel may be an element added to prevent secondary processing brittleness caused by an addition of P. When a content of B exceeds 0.003%, a problem may occur in which an excessive amount of B may cause a reduction in the elongation. The content of B may be controlled to 0.003% or less and, at this time, 0% may be excluded, considering an amount of B that is added inevitably.

In the embodiment, the complex-phase steel sheet may preferably include a balance of iron (Fe) and other inevitable impurities, in addition to the above components.

The complex-phase steel sheet according to the embodiment satisfying the above-mentioned composition may preferably include ferrite (F) as a main phase and martensite (M) as a secondary phase, as microstructures and, at this time, a portion of the complex-phase steel sheet may include bainite (B). Here, 1% to 8% of martensite may preferably be included in the overall microstructure by area fraction.

At this time, it may be preferable that a fraction of fine martensite be from 1% to 8% at a ¼t point, based on a total thickness (t). Problems may occur in which when the fraction of martensite is less than 1%, it may be difficult to secure the strength, and when the fraction of martensite exceeds 8%, the strength may become excessively high, and it may thus be difficult to secure required processability.

Further, it may be preferable that an occupancy ratio (M %) of martensite having an average particle diameter of less than 1 μm and present in grain boundaries of ferrite, defined as the following Formula 1, satisfy 90% or more. That is, as fine martensite, having an average particle diameter of less than 1 μm, is primarily present in the grain boundaries of ferrite but not in crystal grains of ferrite, fine martensite may be advantageous in improving ductility, while maintaining a low yield ratio.

$$M(\%)=\{M_{gb}/(M_{gb}+M_{in})\}\times 100, \quad \text{Formula 1}$$

(where $M_{gb}$ may refer to the amount of martensite present in the grain boundaries of ferrite, and $M_{in}$ may refer to the amount of martensite present in crystal grains of ferrite. The martensite may have an average particle diameter of 1 μm or less).

As described above, when the occupancy ratio of martensite present in the grain boundaries of ferrite is 90% or more, the yield ratio before skin pass rolling may be restricted to 0.55 or less, and may be controlled to an appropriate level by performing the skin pass rolling later. When the occupancy ratio of martensite is less than 90%, problems may occur in which when the martensite formed in the crystal grains is strained in tension, the yield strength may increase, to increase the yield ratio and to preclude the control of the yield ratio through the skin pass rolling. In addition, the elongation may be reduced. This is the reason that martensite present in the crystal grains may significantly disturb the progression of potentials during processing, to cause a rapid increase in the yield strength, rather than in the tensile strength, and also that an excessive number of potentials in the crystal grains of ferrite, while a large amount of martensite is formed in the crystal grains of ferrite, to thus impede movements of movable potentials during the processing.

In addition, in the complex-phase steel sheet according to the embodiment, an area ratio (B %) of bainite in the overall complex-phase structure, defined as the following Formula 2, may preferably be 3% or less.

$$B(\%)=\{BA/(MA+BA)\}\times 100, \quad \text{Formula 2}$$

(where BA may refer to bainite area, and MA may refer to martensite area).

In the embodiment, it may be important to control the area ratio of bainite in the overall complex-phase structure to be low. This is because C and N, solid solution elements present in the crystal grains of bainite rather than in those of martensite, readily stick to potentials, to impede movements of the potentials and exhibit discontinuous yielding behavior, thus significantly increasing the yield ratio.

Thus, when the area ratio of bainite in the overall secondary phase structure is 3% or less, the yield ratio before the skin pass rolling may be restricted to 0.55 or less, and may be controlled to an appropriate level by performing the skin pass rolling later. When the area ratio of bainite exceeds 3%, the yield ratio before the skin pass rolling may exceed 0.55; thus, it may be difficult to manufacture the low yield ratio-type complex-phase steel sheet, and the ductility may be reduced.

The complex-phase steel sheet according to the embodiment, satisfying both the above-mentioned composition and microstructure, may facilitate the control of the yield ratio through the skin pass rolling and, at this time, the control of the yield ratio may be achieved by controlling a skin pass reduction ratio.

In the embodiment, a value (a calculated value) derived from a conditional formula, defined as the following Formula 3, may be defined as a theoretically derived yield ratio. Thus, a required high or low yield ratio-type complex-phase steel sheet may be provided.

$$\text{Calculated value}=(0.1699\times x)+0.4545, \quad \text{Formula 3}$$

(where x may refer to skin pass reduction ratio (%)).

In more detail, when the low yield ratio-type complex-phase steel sheet, in which a value calculated by Formula 3 above, that is, a theoretically derived yield ratio value, satisfying 0.45 to 0.6, is desired to be manufactured, a skin pass reduction ratio of 0.85% or less (excluding 0%) may be applied, and when the high yield ratio-type complex-phase steel sheet having a theoretically derived yield ratio of more than 0.6 is desired to be manufactured, a skin pass reduction ratio of 0.86% to 2.0% may be applied.

FIG. 1 depicts a graph of changes in a yield ratio according to a skin pass reduction ratio, and it may be confirmed that as the skin pass reduction ratio increases, the yield ratio of a steel sheet may be increased. This may allow the complex-phase steel sheet according to the embodiment to be manufactured as the steel sheet having a required yield ratio by adjusting the skin pass reduction ratio.

The control of the yield ratio according to the skin pass reduction ratio will hereinafter be described in more detail in terms of manufacturing conditions.

Hereinafter, a method of manufacturing a complex-phase steel sheet having excellent formability according to another aspect in the present disclosure will be described in detail.

Schematically, in the complex-phase steel sheet according to the embodiment, a steel slab satisfying the above-mentioned composition may be reheated under common conditions and hot rolled to manufacture a hot-rolled steel sheet, and then the hot-rolled steel sheet may be coiled. Thereafter, the coiled hot-rolled steel sheet may be cold rolled at an appropriate reduction ratio to manufacture a cold-rolled steel sheet, and may then be annealed in a continuous annealing furnace or a continuous galvannealing furnace to thus manufacture the complex-phase steel sheet.

Hereinafter, detailed conditions for each operation will be described.

First, in the embodiment, the steel slab as described above may preferably be reheated under common conditions. This is done to perform the subsequent hot rolling process smoothly and to obtain sufficient physical properties of a target steel sheet. The present disclosure is not particularly limited to such reheating conditions, as long as they are common. As an example, the reheating process may be performed in a temperature range of 1,100° C. to 1,300° C.

Subsequently, the reheated steel slab may be finish hot rolled, preferably at an Ar3 transformation point or higher under common conditions, to manufacture the hot-rolled steel sheet. The present disclosure is not limited as to conditions for the finish hot rolling, and a common hot rolling temperature may be used. As an example, the finish hot rolling may be performed in a temperature range of 800° C. to 1,000° C.

The hot-rolled steel sheet manufactured as described above may be coiled, preferably at 450° C. to 700° C. At this time, when the coiling temperature is less than 450° C., an excessive amount of martensite or bainite may be generated, causing an excessive increase in strength of the hot-rolled steel sheet, and thus there may be concerns that a problem may occur, such as a defective shape or the like, caused by a load during the subsequent cold rolling. In contrast, when the coiling temperature exceeds 700° C., a problem may occur in which surface concentration of the steel intensifies, caused by elements such as Si, Mn, or B, degrading wettability of a hot-dip galvanizing material. Thus, considering this, it may be preferable to control the coiling temperature to 450° C. to 700° C.

Thereafter, it may be preferable to manufacture a cold-rolled steel sheet by pickling and cold rolling the coiled hot-rolled steel sheet. It may be preferable to perform the cold rolling at a reduction ratio of 40% to 80%. When the reduction ratio is less than 40%, problems may occur, in which it may be difficult to secure a target thickness and to correct a shape of the steel sheet. In contrast, when the reduction ratio exceeds 80%, problems may occur such that cracking may be highly likely to occur in an edge portion of the steel sheet, and load of the cold rolling may be increased.

It may be preferable to continuously anneal the cold-rolled steel sheet manufactured as described above in a temperature range of 760° C. to 850° C. At this time, the continuous annealing process may be performed in the continuous annealing furnace or the continuous galvannealing furnace.

The continuous annealing process may be performed to simultaneously recrystallize, to form ferrite and austenite, and to distribute carbon. At this time, when a temperature of the continuous annealing process is less than 760° C., problems may occur in which recrystallization may not be performed sufficiently, and it may be difficult to form sufficient austenite, thus causing difficulties in securing the strength required in the embodiment. In contrast, when the temperature exceeds 850° C., problems may occur in which productivity may be lowered, and austenite may be excessively produced so that bainite may be included after cooling, thus reducing the ductility. Thus, considering this, it may be preferable to control the continuous annealing temperature range to 760° C. to 850° C.

The steel sheet manufactured as described above may be the complex-phase steel sheet required in the embodiment, and may preferably have internal microstructures, including ferrite as a main phase and martensite as a secondary phase. At this time, the steel sheet may satisfy that a fraction of fine martensite at a ¼t point, based on a total thickness (t), is 1% to 8%, that an occupancy ratio (M %) of martensite having an average particle diameter of less than 1 μm and present in grain boundaries of ferrite, defined as the following Formula 1, is 90% or higher, and that an area ratio (B %) of bainite of overall secondary phase structures, defined as the following Formula 2, is 3% or lower. The descriptions of the internal structure and numerical limitations thereof are the same as mentioned above.

Meanwhile, in the embodiment, it may be preferable to further perform a skin pass rolling process after the continuous annealing process, and the yield ratio of the steel sheet may be adjusted through the skin pass rolling process. In more detail, the present disclosure may provide the required complex-phase steel sheet having a high or low yield ratio by controlling the skin pass rolling reduction ratio.

$$\text{Calculated value}=(0.1699\times x)+0.4545, \qquad \text{Formula 3}$$

(where x may refer to skin pass reduction ratio (%)).

At this time, when the skin pass reduction ratio (%) of Formula 3 is controlled to 0.85% or less (excluding 0%), movable potentials introduced by rolling may facilitate material deformation during tensile deformation, to reduce a yield strength-to-tensile strength ratio, and a steel sheet satisfying a yield ratio of 0.45 to 0.6 may be manufactured.

When the skin pass rolling is not performed, a minimum yield ratio may be secured. However, it may be preferable to perform the skin pass rolling at a minimum skin pass reduction ratio in order to adjust the shape of the steel sheet and uniformize a plating layer. Thus, 0% may be excluded.

When the skin pass reduction ratio is controlled to 0.86% to 2.0%, a large number of potentials may agglomerate with each other to increase a work hardening phenomenon, thus raising the yield strength-to-tensile strength. A steel sheet having a yield ratio of more than 0.6 and less than or equal to 0.8 may be manufactured.

When such a high-yield ratio-type complex-phase steel sheet is desired to be manufactured, it may be preferable to control the skin pass reduction ratio to 0.86% or more. When the skin pass reduction ratio exceeds 2.0%, problems may occur in which the yield ratio may exceed 0.8, so that the complex-phase steel sheet may lose its function as a complex-phase steel and, due to an excessively high degree of yield strength, a spring back phenomenon (defective shape accuracy of processed components) may appear.

As described above, the complex-phase steel sheet according to the embodiment may facilitate the control of the yield ratio according to the skin pass reduction ratio, may be a steel sheet having excellent formability, and may be suitably used for automotive exterior panels.

Hereinafter, the present disclosure will be described in more detail with reference to the embodiment. However, the following embodiment is only illustrative of the present disclosure in greater detail and does not limit the scope of the present disclosure.

[Mode for Invention]

(Embodiment)

Steel types, having the compositions illustrated in Table 1 below, were manufactured under the conditions listed in Table 2 below, and then physical properties thereof were confirmed. At this time, a yield ratio, in a state in which skin pass rolling had not been performed, as a target material characteristic, was targeted at 0.5 or less.

A tensile test of each specimen was performed in a C direction using Japanese Industrial Standards (JIS), and the microstructure fractions were measured by observing an annealed steel sheet at a ¼t point, based on the total thickness thereof, using an electron microscope. Further, the occupancy rates of martensite were measured by observing martensite using a scanning electron microscope (SEM) (×3,000 magnification), and then performing a count point operation.

TABLE 1

| | Composition (wt %) | | | | | | | | | |
|---|---|---|---|---|---|---|---|---|---|---|
| Classification | C | Si | Mn | Cr | Mo | P | S | sol.Al | B | N |
| Inventive Steel 1 | 0.025 | 0.15 | 1.75 | 0.5 | 0.04 | 0.023 | 0.006 | 0.031 | 0.0006 | 0.0031 |
| Inventive Steel 2 | 0.031 | 0.21 | 1.81 | 0.4 | 0.05 | 0.018 | 0.005 | 0.028 | 0.0005 | 0.0028 |
| Inventive Steel 3 | 0.036 | 0.18 | 1.76 | 0.3 | 0.04 | 0.023 | 0.005 | 0.024 | 0.0005 | 0.0048 |
| Inventive Steel 4 | 0.037 | 0.15 | 2.03 | 0.3 | 0.05 | 0.021 | 0.005 | 0.025 | 0.0012 | 0.0049 |
| Inventive Steel 5 | 0.052 | 0.13 | 2.16 | 0.3 | 0.05 | 0.024 | 0.005 | 0.035 | 0.0005 | 0.0045 |
| Comparative Steel 1 | 0.083 | 0.17 | 1.81 | 0 | 0 | 0.018 | 0.006 | 0.048 | 0 | 0.0036 |

TABLE 2

| | Manufacturing Conditions | | | | Physical Properties | | | | | | | | |
|---|---|---|---|---|---|---|---|---|---|---|---|---|---|
| Classification | Coiling Temperature (° C.) | Cooling Reduction Ratio (%) | Annealing Temperature (° C.) | Skin Pass Rolling (%) | Grain Boundary M Occupancy Ratio (M %) | B Area Ratio (B %) | Total M Fraction (%) | Yield Ratio (1) | Yield Strength (MPa) | Tensile Strength (MPa) | Ductility (%) | Yield Ratio (2) | Note |
| Inventive Steel 1 | 553 | 62 | 782 | 0.2 | 93 | 2.5 | 3.5 | 0.44 | 251 | 492 | 33 | 0.51 | Inventive Example |
| | 557 | 61 | 785 | 0.6 | 92 | 2.3 | 3.2 | 0.44 | 275 | 500 | 32 | 0.55 | Inventive Example |
| Inventive Steel 2 | 556 | 62 | 779 | 0.5 | 94 | 2.1 | 2.9 | 0.43 | 273 | 506 | 32 | 0.54 | Inventive Example |
| | 563 | 63 | 743 | 0.5 | 86 | 4.8 | 2.3 | 0.55 | 312 | 495 | 34 | 0.63 | Comparative Example |
| Inventive Steel 3 | 652 | 62 | 821 | 1.3 | 95 | 1.8 | 4.5 | 0.44 | 323 | 513 | 31 | 0.63 | Inventive Example |
| | 651 | 63 | 823 | 1.2 | 93 | 1.9 | 4.2 | 0.43 | 308 | 497 | 33 | 0.62 | Inventive Example |
| Inventive Steel 4 | 482 | 61 | 835 | 0.7 | 92 | 2.6 | 1.9 | 0.44 | 331 | 581 | 27 | 0.57 | Inventive Example |
| | 485 | 63 | 855 | 0.7 | 86 | 5.2 | 12.6 | 0.62 | 329 | 522 | 30 | 0.63 | Comparative Example |
| Inventive Steel 5 | 648 | 76 | 835 | 1.5 | 94 | 2.1 | 3.7 | 0.42 | 318 | 505 | 31 | 0.63 | Inventive Example |
| | 645 | 75 | 836 | 1.6 | 93 | 2.2 | 3.5 | 0.43 | 321 | 502 | 32 | 0.64 | Inventive Example |
| Comparative Steel 5 | 556 | 58 | 786 | 0.8 | 83 | 4.8 | 11.2 | 0.58 | 335 | 540 | 29 | 0.62 | Comparative Example |
| | 552 | 58 | 789 | 0.8 | 82 | 4.6 | 13.1 | 0.57 | 329 | 522 | 27 | 0.63 | Comparative Example |

(In Table 2 above, the yield ratio (1) indicates the values measured before performing skin pass rolling, and the yield ratio (2), the yield strength, the tensile strength, and the ductility indicate the values measured after the skin pass rolling. Further, in Table 2 above, M indicates martensite, and B indicates bainite.)

As illustrated in Tables 1 and 2, it can be confirmed that the Inventive Examples, satisfying both the compositions and the manufacturing conditions proposed in the embodiment, may secure excellent ductility as well as strength.

In contrast, when the compositions are satisfied, but the manufacturing conditions are not satisfied, in the embodiment, or when the compositions are not satisfied in the embodiment, it can be confirmed that the total fraction of martensite, as well as the fraction of bainite in the internal structure, may be increased, and thus the yield ratio may be greatly increased after the skin pass rolling. These steel types may be expected to have a high probability of defects occurring during processing, such as fractures or the like.

The invention claimed is:

1. A steel sheet, having excellent comprising:

by wt %, 0.01% to 0.08% of carbon (C), 1.5% to 2.5% of manganese (Mn), 1.0% or less, excluding 0%, of chromium (Cr), 1.0% or less excluding 0%, of silicon (Si), 0.1% or less, excluding 0%, of phosphorus (P), 0.01% or less excluding 0%, of sulfur (S), 0.01% or less, excluding 0%, of nitrogen (N), 0.02% to 0.1% of acid soluble aluminum (sol. Al), 0.1% or less, excluding 0%, of molybdenum (Mo), 0.003% or less excluding 0%, of boron (B), and a balance of iron (Fe) and inevitable impurities, the sum (Mn+Cr) of wt % of manganese (Mn) and chromium (Cr) satisfying 1.5% to 3.5%, wherein the steel sheet includes ferrite as a main phase, a fraction of fine martensite at a ¼t point, based on a total thickness (t) of the steel sheet is from 1% to 8%, an occupancy ratio (M %) of martensite having an average particle diameter of less than 1 μm and present in grain boundaries of the ferrite defined as the following Formula 1, is 90% or higher, and an area ratio (B %) of bainite of an overall secondary phase microstructure, defined as the following Formula 2, is 3% or lower (including 0%), $$M\ (\%)=\{M_{gb}/(M_{gb}+M_{in})\}\times 100, \qquad \text{Formula 1}$$

where $M_{gb}$ refers to the amount of martensite present in the grain boundaries of the ferrite, and $M_{in}$ refers to the amount of martensite present in crystal grains of the ferrite, and $$B\ (\%)=\{BA/(MA+BA)\}\times 100, \qquad \text{Formula 2}$$

where BA refers to a bainite area, and MA refers to a martensite area, wherein a fraction of the martensite of the overall microstructure is 1% to 8%.

2. The steel sheet of claim 1, wherein a yield ratio (YR) is 0.45 to 0.6.

3. The steel sheet of claim 1, wherein a yield ratio (YR) is greater than 0.6 and less than or equal to 0.8.

4. A method of manufacturing a steel sheet, the method comprising:

reheating a steel slab, including, by wt %, 0.01% to 0.08% of carbon (C), 1.5% to 2.5% of manganese (Mn), 1.0% or less excluding 0%, of chromium (Cr), 1.0% or less excluding 0%, of silicon (Si), 0.1% or less excluding 0%, of phosphorus (P), 0.01% or less excluding 0%, of sulfur (S), 0.01% or less excluding 0%, of nitrogen (N), 0.02% to 0.1% of acid soluble aluminum (sol. Al), 0.1% or less excluding 0%, of molybdenum (Mo), 0.003% or less excluding 0%, of boron (B), and a balance of iron (Fe) and inevitable impurities, the sum (Mn+Cr) of wt % of manganese (Mn) and chromium (Cr) satisfying 1.5% to 3.5%;

manufacturing a hot-rolled steel sheet by finish hot rolling the reheated steel slab at a transformation point Ar3 or higher;

coiling the hot-rolled steel sheet at 450° C. to 700° C.;

manufacturing a cold-rolled steel sheet by cold rolling the coiled hot-rolled steel at a reduction ratio of 40% to 80%; and annealing the cold-rolled steel sheet in a continuous annealing furnace or a continuous galvannealing furnace in a temperature range of 760° C. to 850° C., wherein the annealed steel sheet includes ferrite as a main phase, a fraction of fine martensite at a ¼t point, based on a total thickness (t) of the annealed steel sheet, is from 1% to 8%, an occupancy ratio (M %) of martensite, having an average particle diameter of less than 1 μm and present in grain boundaries of the ferrite defined as the following Formula 1, is 90% or higher, and an area ratio (B %) of bainite of an overall secondary phase microstructure, defined as the following Formula 2, is 3% or lower (including 0%), $$M\ (\%)=\{M_{gb}/(M_{gb}+M_{in})\}\times 100, \qquad \text{Formula 1}$$

where Mgb refers to the amount of martensite present in the grain boundaries of the ferrite, and Min refers to the amount of martensite present in crystal grains of the ferrite, and $$B(\%)=\{BA/(MA+BA)\}\times 100, \qquad \text{Formula 2}$$

where BA refers to a bainite area, and MA refers to a martensite area, wherein a fraction of the martensite of the overall microstructure is 1% to 8%.

5. The method of claim 4, further comprising skin pass rolling the annealed steel sheet after the annealing.

6. The method of claim 5, wherein, when the reduction ratio during the skin pass rolling is 0. 85% or lower, excluding 0%, a value calculated by the following Formula 3 satisfies a range of 0.45 to 0.6, and $$\text{Calculated value}=(0.1699\times x)+0.4545, \qquad \text{Formula 3}$$

where x refers to skin pass reduction ratio(%).

7. The method of claim 5, wherein, when the reduction ratio during the skin pass rolling is 0.86% to 2.0%, a value calculated by Formula 3, above, satisfies a range of greater than 0.6 and less than or equal to 0.8.

* * * * *